US005131880A

United States Patent [19]

Nesbit et al.

[11] Patent Number: 5,131,880

[45] Date of Patent: Jul. 21, 1992

[54] CRUSHABLE TOY CAR APPARATUS

[76] Inventors: Mark S. Nesbit, 1248 17th St., West Des Moines, Iowa 50265; Charles E. Nesbit, 9206 Willard Ct., Des Moines, Iowa 50322

[21] Appl. No.: 690,872

[22] Filed: Apr. 17, 1991

[51] Int. Cl.[5] ..... A63H 33/40; A63H 17/02; A63H 17/26; A63H 17/44

[52] U.S. Cl. ..... 446/180; 446/6; 446/469; 446/221; 446/423; 273/458

[58] Field of Search ..... 446/180, 176, 183, 185, 446/186, 188, 195, 197, 198, 199, 4, 6, 469, 470, 471, 431, 441, 423, 424, 220, 221, 224; 273/457, 458

[56] References Cited

U.S. PATENT DOCUMENTS

| | | | |
|---|---|---|---|
| 2,937,557 | 5/1960 | Hellman | 446/188 X |
| 3,589,047 | 6/1971 | Hess et al. | 446/176 X |
| 3,695,148 | 10/1972 | Baginski et al. | 446/197 X |
| 4,171,806 | 10/1979 | Goldfarb et al. | 273/458 |
| 4,240,224 | 12/1980 | Katzman et al. | 446/197 |
| 4,259,805 | 4/1981 | Hornsby, Jr. | 446/198 |
| 4,261,133 | 4/1981 | Hanson et al. | 446/424 X |
| 4,360,988 | 11/1982 | Schoenfield et al. | 446/424 |
| 4,571,197 | 2/1986 | Kulesza et al. | 446/6 |
| 4,693,693 | 9/1987 | Kennedy et al. | 446/6 |
| 4,936,809 | 6/1990 | Auer et al. | 446/184 |
| 5,029,851 | 7/1991 | Hagen | 446/224 X |

FOREIGN PATENT DOCUMENTS

| | | | |
|---|---|---|---|
| 2028474 | 12/1971 | Fed. Rep. of Germany | 446/197 |
| 2087742 | 6/1982 | United Kingdom | 446/197 |

*Primary Examiner*—Robert A. Hafer
*Assistant Examiner*—D. Neal Muir
*Attorney, Agent, or Firm*—Henderson & Sturm

[57] ABSTRACT

A crushable car body (20) having a pressurized deformable bladder (50) associated with the upper car body portion (30) such that when downward pressure was exerted on the roof (31) of the car body (20) the car body (20) would be deformed to simulate a crushed car; and, wherein the reintroduction of positive pressure into the deformable bladder will return the car body (20) to its original configuration.

45 Claims, 5 Drawing Sheets

CRUSHABLE TOY CAR APPARATUS

TECHNICAL FIELD

The present invention relates to the field of toy cars in general, and in particular to a crushable car apparatus for use in a simulated monster truck environment.

BACKGROUND ART

As can be seen by reference to the following U.S. Pat. Nos. 4,261,133; 4,571,197; 4,693,693; and 4,936,809; the prior art is replete with myriad and diverse impact responsive toy car bodies used in different simulated environments.

While all of the aforementioned prior art constructions are more than adequate for the basic purpose and function for which they have been specifically designed, these prior art constructions are likewise invariably deficient with regard to the fact that almost all of them contemplate the existence of a laterally applied force to produce the desired results set forth in the bodies of their respective specifications.

Furthermore none of the cited references of record contemplate the use of plural car bodies which are mechanically and/or pneumatically connected to one another to simulate a row of cars such as would be encountered in a car crushing "monster truck" environment.

As a consequence of the foregoing situation, there has existed a longstanding need particularly among those toy manufacturers who produce reduced scale versions of "monster trucks", for a crushable toy car apparatus which is responsive to a downward force applied by the wheels of a toy vehicle to simulate the results produced when monster trucks roll over real cars; and, the provision of such a construction is a stated objective of the present invention.

DISCLOSURE OF THE INVENTION

Briefly stated, the crushable toy car apparatus that forms the basis of the present invention comprises a simulated car body having an upper body portion and a lower body portion; wherein, the upper body portion is moveable towards the lower body portion in response to a downwardly directed force applied through another toy vehicle; and, means for restoring the upper body portion to its original position relative to the lower body portion prior to the application of force.

In addition the preferred embodiment of this invention further contemplates a fluid chamber operatively associated with the upper and lower body portions to effect the restoration of the body portions to their original configuration.

As will be explained in greater detail further on in the specification, this invention also contemplates the pneumatic interconnection of a plurality of simulated car bodies in a side to side relationship to one another; wherein, a disparate toy vehicle will travel up one side of an elevated ramp arrangement and then traverse and crush the upper body portions of the cars; and, then the upper body portions will be restored to their original configuration by the introduction of above atmospheric air into the pneumatic interconnection between the car bodies.

As will also be explained in greater detail further on in the specification this invention also contemplates that the pneumatic interconnection between the car bodies can be arranged either in a series or a parallel relationship.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
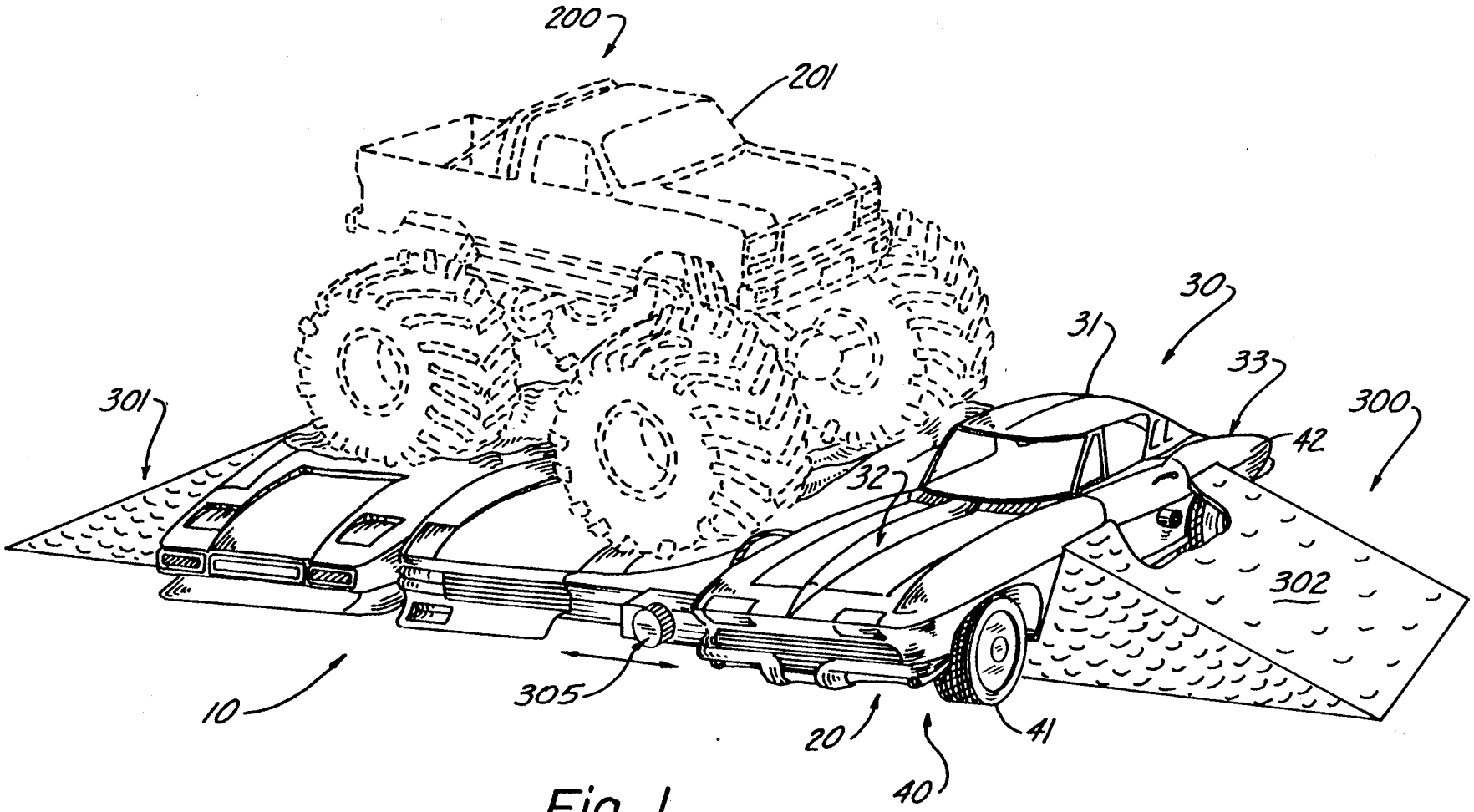
FIG. 1 is a perspective view of the crushable toy car apparatus of this invention in its intended environment.

As can be seen by reference to the drawings, and in particular to FIG. 1, the crushable toy car apparatus that forms the basis of the present invention is designated generally by the reference numeral (10). Furthermore as mentioned previously the car apparatus (10) is designed and intended for use in conjunction with another type of wheeled vehicle (200) such as a toy "monster" truck (201) as well as an elevated ramp arrangement (300) which will be described in greater detail further on in the specification.

The crushable toy car apparatus (10) comprises in general a car body (20) which for the purposes of this invention will be divided into an upper body portion (30) and a lower body portion (40); wherein, in the different versions of this invention the dividing line between the upper (30) and lower (40) body portions will vary. However, for most of the versions described herein the dividing line between the upper (30) and lower (40) body portions will pass generally through the middle of the car body (20); such that the roof (31) hood (32) and trunk (33) will be associated with the upper body portion (30) and the wheels (41) and lower half of the chassis (42) will be associated with the lower body portion (40).

Figure 2:
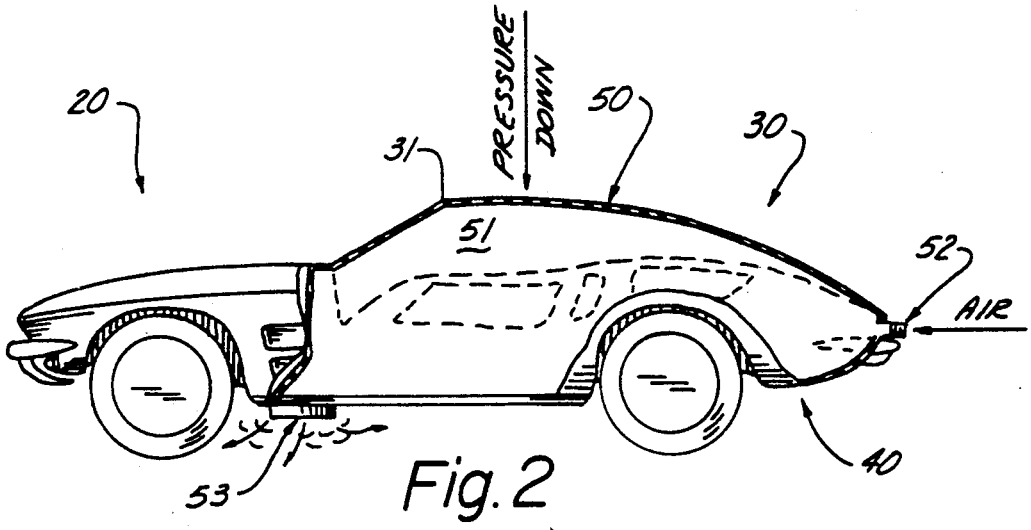
FIG. 2 is a partial cross-sectional view showing one pneumatic version of the invention.

In the first version of the preferred embodiment depicted in FIG. 2, an interior chamber (51) is formed within and defined by a pneumatic bladder (50) equipped with both inlet (52) and outlet (53) ports which will allow the bladder (50) to be fully inflated to the normal car configuration depicted in solid lines; and, to be deflated to the crushed car configuration depicted in dashed lines.

It should further be noted and emphasized at this juncture that in all of the inflatable versions of this invention the bladder (50) requires the introduction of positive pressure (i.e. above atmospheric) to restore the bladder (50) to its original fully inflated configuration.

Still referring to FIG. 2 it can be seen that the bladder (50) encompasses portions of both the upper (30) and lower (40) body portions and it is to be understood that the bladder (50) can be conformed to comprise the outer periphery of the entire car body (20); such that the entire car body (20) is capable of being crushed or deflated.

Figure 3:
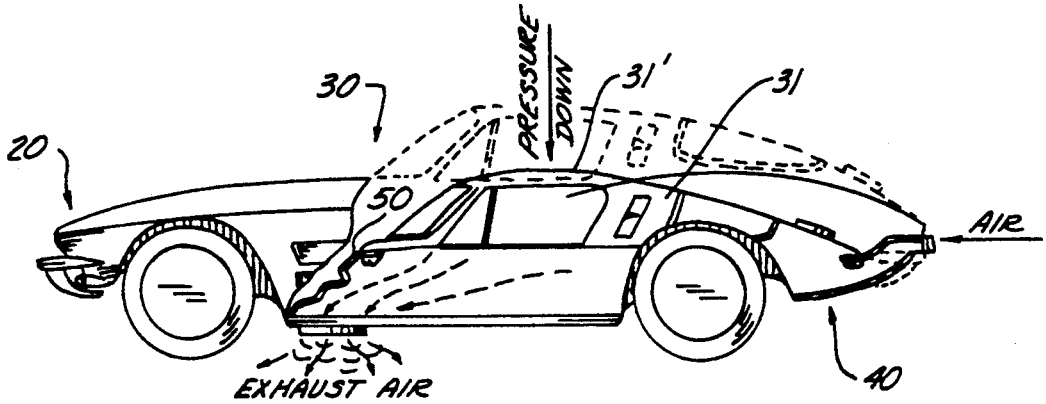
FIG. 3 is a partial cross-sectional view showing another pneumatic version of the invention.

In the second version of the preferred embodiment depicted in FIG. 3, the bladder (50) may be operatively associated with at least the roof (31) of the upper body portion (30); wherein the roof (31) forms either an extension of the bladder (50); or the roof (31) comprises a separate structural element that rests upon and is operatively attached to the bladder (50). In this latter situation, the roof (31) may either comprise a relatively rigid structural element, or an easily deformable structural element such as would be created by fabricating the roof (31) from a deformable material (31') such as a thin flexible air impervious membrane; wherein, the reinflation of the bladder (50) would restore the deformable material to its original configuration.

In the third version of the preferred embodiment depicted in FIGS. 8 through 11, the upper body portion (30) for the purposes of discussion only comprises the roof (31) of the car body (20); while, the lower body portion (40) comprises the chassis (42) of the car body.

Figure 10:
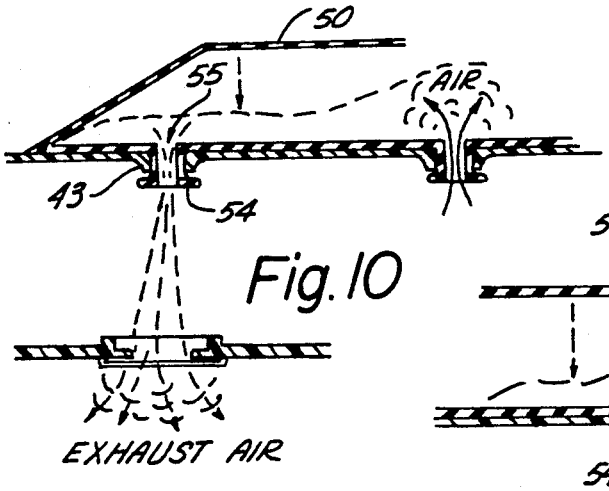
FIG. 10 is a detailed cross-sectional view of one form of the alternate version depicted in FIG. 9.
Figure 11:
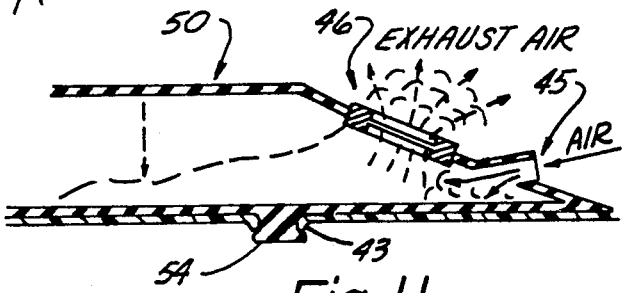
FIG. 11 is a detailed cross-sectional view of another form of the alternate version depicted in FIG. 9.

As can best be seen by reference to FIGS. 10 and 11 the bladder (50) constitutes the roof (31) or upper body portion (30); wherein, the bladder (50) is operatively attached to the chassis (42) or lower body portion (40). Furthermore as shown in FIGS. 10 and 11, the lower body portion (40)/chassis (42) is provided with at least one aperture (43) which is dimensioned to snugly receive at least one suitably dimensioned post element (54) which depends downwardly from the bladder (50).

In one variation of the third embodiment depicted in FIG. 10, the post element (54) is provided with a combined inlet/outlet port (55) which will allow the bladder 50/roof (31) to be inflated and exhausted through the lower body portion (40)/chassis (42). It should also be apparent that in this variation the lower body portion (40) would have to be equipped with a suitable inflation port (45) and an exhaust port (46).

In the other variation of the third embodiment depicted in FIG. 11, the post element (54) is solid and the bladder (50) is provided with its own inlet (52) outlet (53) ports; wherein, there is no fluid communication between the upper body portion (30)/roof 31/bladder (50) and the lower body portion (40)/chassis (42).

Figure 5:
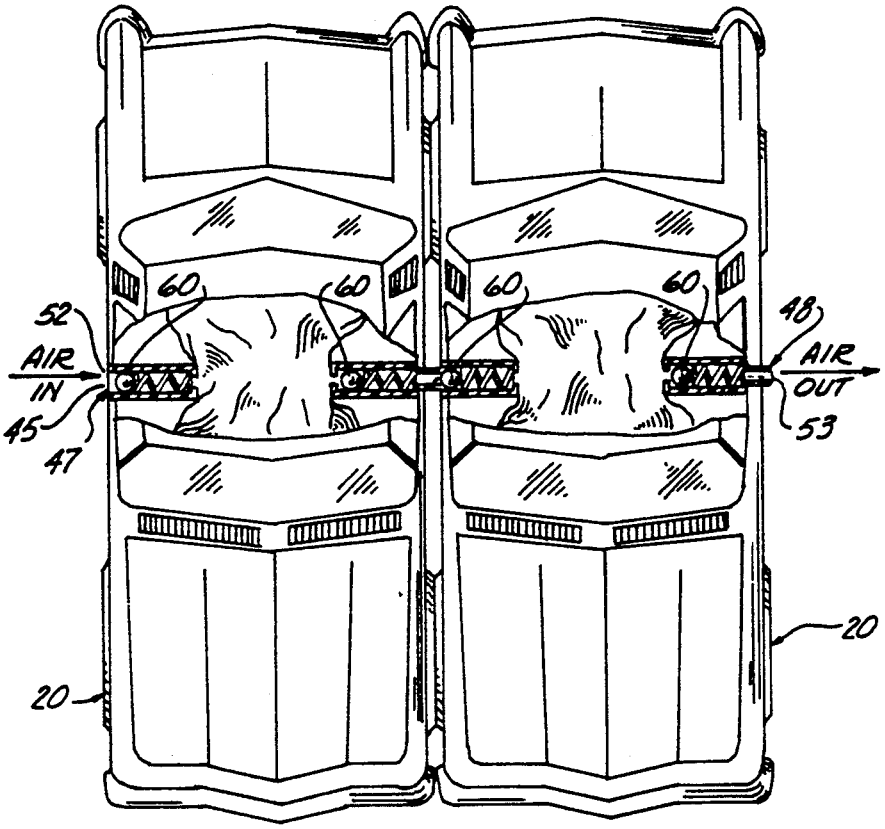
FIG. 5 is a top plan view showing a typical serial pneumatic connection between the toy cars.
Figure 6:
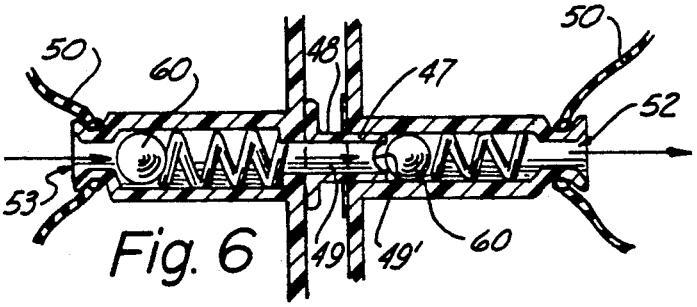
FIG. 6 is an isolated detail view of one proposed interconnection between the cars.
Figure 8:
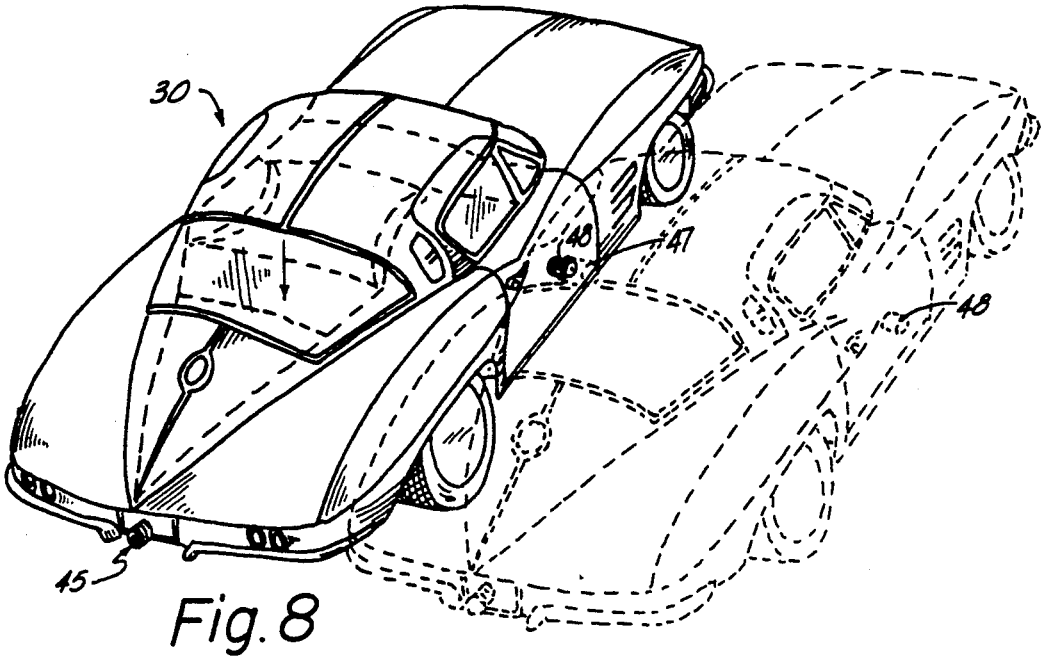
FIG. 8 is a perspective view illustrating the side by side interconnection between the toy cars.
Figure 9:
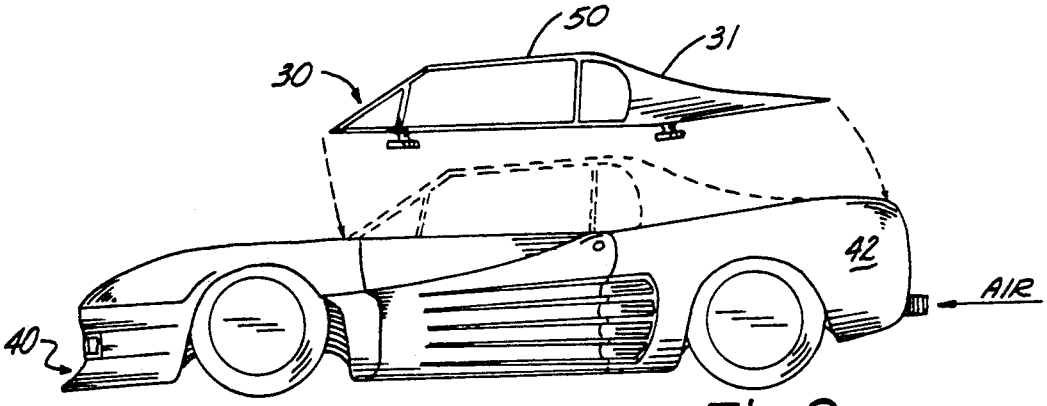
FIG. 9 is an exploded perspective view of an alternate version of the preferred embodiment.

As mentioned previously this invention contemplates the serial fluid interconnection of a plurality of car bodies (20) in a side to side fashion as depicted in FIGS. 5, 6, and 8.

Furthermore as can best be seen by reference to FIGS. 5 and 6, this arrangement would typically involve one-way valve (60) formed in the inflation port (45) disposed in a female connector element (47) formed on one side of the chassis (42); and, a similar one way valve (60) disposed within, and on the opposite side of, the chassis(42); wherein, the exhaust port (46) would have a male connector element (48) projecting outwardly from the opposite side of the chassis (42); and, wherein the inlet (45) and outlet (46) ports would be fluidly connected to the bladder (50).

As can best be seen by reference to FIG. 6, each one way valve 60 is provided with a conventional spring biased ball valve and valve seat arrangement; wherein, the male connector element (48) comprises a hollow tube (49) having recesses (49') formed on its outboard end; such that the hollow tube (40) will project into the female connector element (47) to unseat the one way valve 60; and, wherein the recesses (49') in the outboard end of the hollow tube (49) allow air to pass around the unseated ball valve to flow through the female connector element (47).

Figure 4:
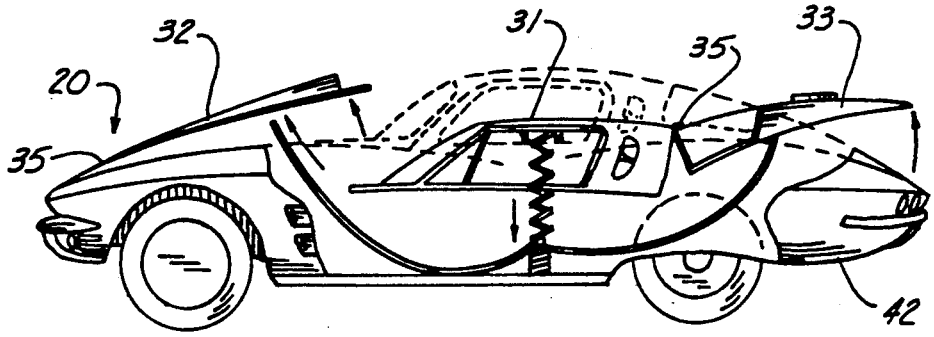
FIG. 4 is a partial cross-sectional view showing a mechanical version of the invention.
Figure 7:
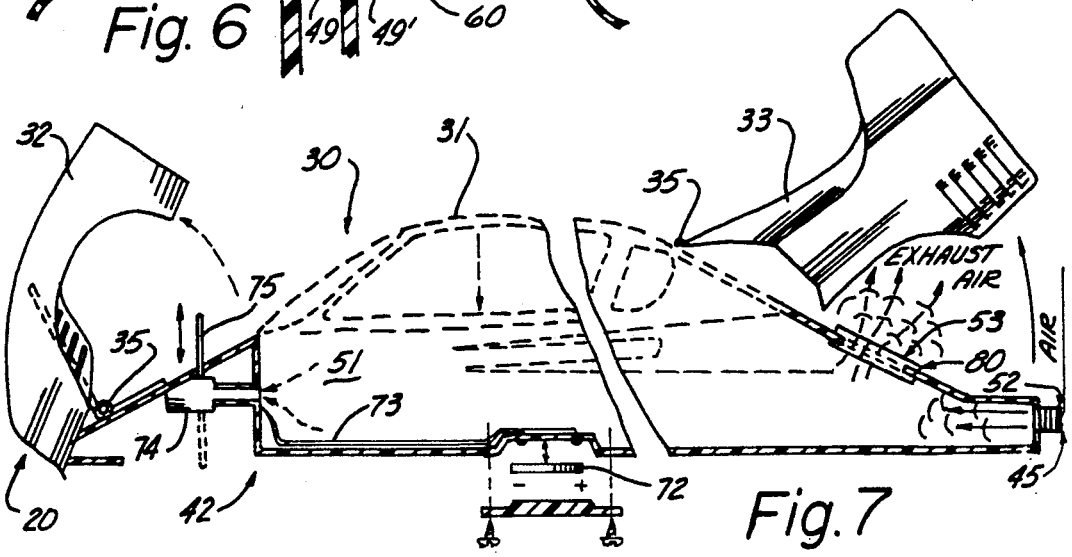
FIG. 7 is a cross-sectional view depicting both pneumatic and a combined pneumatic electromechanical actuation of hood panels on the toy car.

Turning now to FIGS. 4 and 7, it can be seen that this invention further contemplates the provision of pivoted hood (32) and trunk (33) panels on the upper car body (30); wherein, the hood (32) and trunk (33) panels will be forced upwardly in response to a downward force being exerted on the roof (31) of the upper body portion (30) of the car body (20).

In the mechanical version of the preferred embodiment depicted in FIG. 4, the roof (31) is connected by a spring (70) to a pair of arcuate pivoted lever arms (71); wherein, the downward movement of the roof (31) causes the free ends of the lever arms to contact the underside of the hood (32) and trunk (33) to force the hood (32) and trunk (33) upwardly relative to the chassis (42).

In the pneumatic version of the preferred embodiment shown on the right side of FIG. 7, the exhaust outlet (53) is positioned beneath one of the pivoted panels (32 or (33) such that the pressurized air exiting from the outlet 53 will force the panel to pivot upwardly relative to its pivoted connection (35) with the upper body portion (30).

Furthermore in the pneumatic and electro-mechanical version of the preferred embodiment shown on the left side of FIG. 7, the car body (20) is provided with an electrical power source (72) connected by wiring (73) to a pressure sensitive solenoid (74); wherein the solenoid trigger arm (75) is disposed beneath one of the pivoted panels (32) (33); such that the solenoid trigger (75) will be actuated in response to an increase in pressure in the bladder chamber (51) due to a downwardly directed external force being exerted on the upper body portion (30).

Turning once more to FIG. 1, it can be seen that the ramp arrangement (300) comprises an elevated front ramp element (301) operatively and adjustably connected to a reduced height rear ramp element (302); wherein, the height of the front ramp element (301) operatively and adjustably connected to a reduced height rear ramp element (302); wherein, the height of the front ramp element (301) is approximately the same height as the height of one of uncrushed car bodies 20; and, wherein the height of the rear ramp element (301) is approximately the same height as one of the crushed car bodies. This arrangement will allow the vehicle (200) to mount the ramp and contact the upper body portions (30) of the underformed car bodies (20) and to exit onto the rear ramp element (302) at approximately the height of the last crushed car body (20) in line.

It should also be appreciated at this juncture that the slidable adjustment mechanism disposed between the front (301) and rear (302) ramp elements and designated generally as (305) allows the ramp arrangement (300) to be expanded and contracted to accommodate different numbers of car bodies in a side by side relationship.

Figure 12:
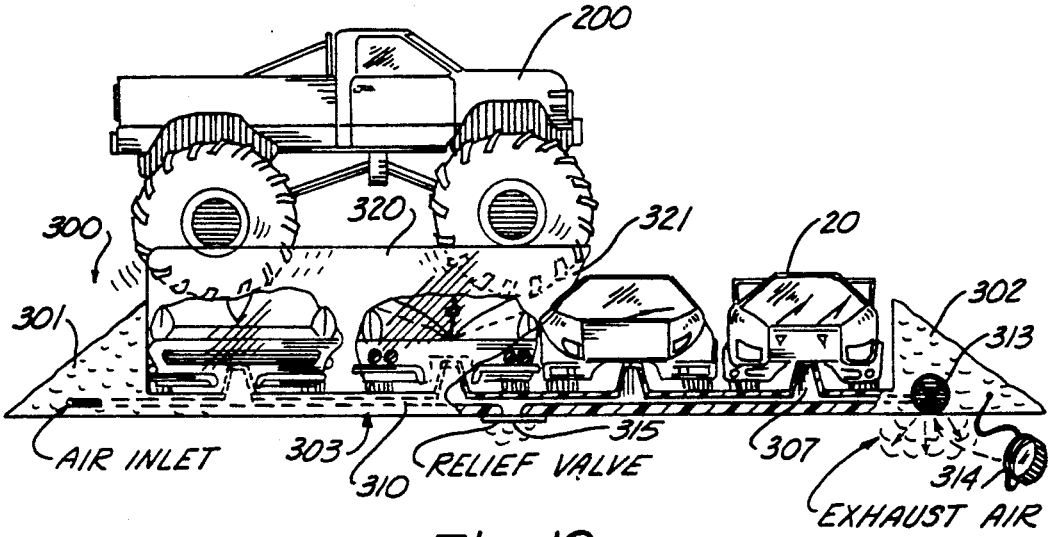
FIG. 12 is a partial cross-sectional view of a parallel pneumatic interconnection between the toy cars; and, FIG. 13 is an enlarged detail view of a typical pneumatic interconnection employed in the invention.
Figure 13:
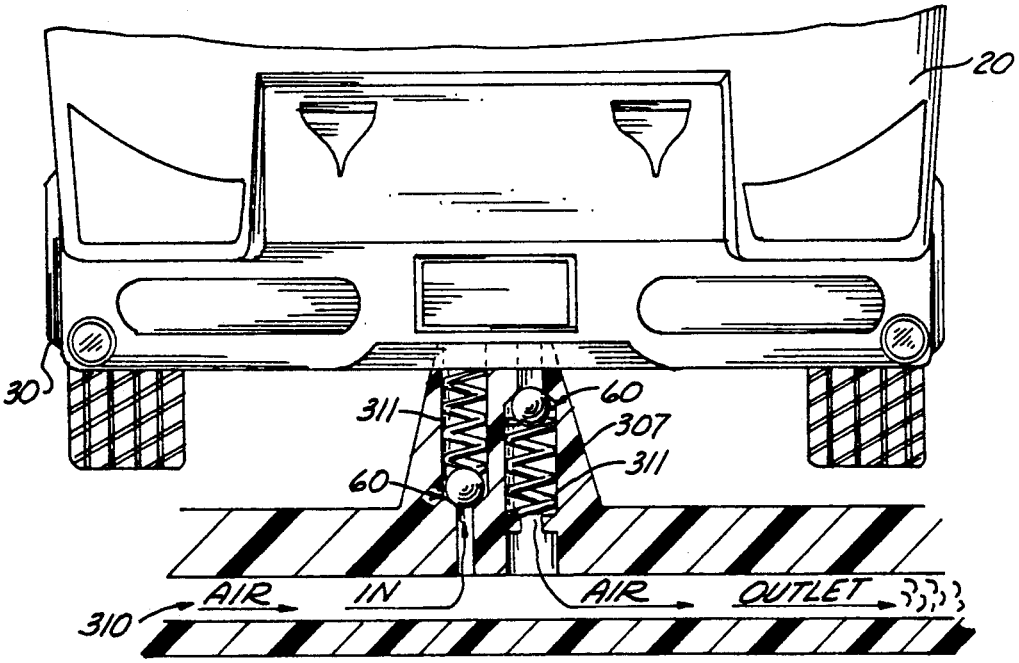

In the parallel pneumatic interconnection between the car bodies (20) depicted in FIGS. 12 and 13, the ramp arrangement (300) comprises a front (301) and rear (302) ramp element rigidly interconnected with one another; wherein, the intermediate portion (303) between the ramp elements (301)(302) contains a plurality of stanchions (307) which are rigidly connected to the lower body portions (30) of a plurality of car bodies (20) disposed in a side by side relationship.

In addition a main pneumatic conduit (310) extends through the ramp arrangement (300) and is provided with a plurality of branch conduits (311); wherein each of the branch conduits (311) are disposed within one of the respective plurality of stanchions (307).

As can also be seen by reference to FIG. 13 each of the stanchions (307) is provided with a pair of oppositely facing one way valves (60) which are adapted to place the main pneumatic conduit into fluid communication with the bladder chamber (51) within each of the car bodies (20).

Furthermore as shown in FIG. 12, the main pneumatic conduit (310) is provided with an outlet port (313) equipped with a closure element (314); so that the main conduit can be sealed when positive pressure air is introduced therein to effect the reinflation of the car bodies (20); and, the main conduit (310) is also provided with a pressure relief valve (315) to insure that the main conduit (310) will be capable of exhausting the pressurized air being generated by the collapsing bladders (50) as the vehicle (200) traverses the car bodies (20).

It should also be appreciated at this juncture that this invention also contemplates the provision of noise generating means (not shown) within either the ramp arrangement (300) or the car bodies (20) to simulate the sounds of cars being crushed as well as the sounds generated by the vehicle (200).

In addition particularly with regard to the structure depicted on the right hand side of FIG. 7 this invention also envisions the use of simulated smoke such as would be generated by talc or other fine powder (80) deposited in or in the vicinity of the exhaust outlet (53); such that when the hood (32) or trunk panel (33) was forced upwardly it would appear that smoke was emanating from the crushed car body (20).

As can also be seen by reference to FIG. 12, the ramp arrangement (300) also contemplates the provision of guide means (320) such as transparent raised sidewalls (321) or side rails (not shown) which will serve to both guide and confine the vehicle (200) as the vehicle (200) traverses the car bodies (20) between the two ramp elements (301) (302).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

We claim:

1. An inflatable recrushable toy car apparatus for use with an inflation means and a crushing vehicle in combination with a ramp arrangement; wherein, the toy car apparatus comprises:

a car body having a roof, hood, trunk, wheels and chassis and further including an upper body portion deformable from a normal body portion configuration to a crushed body portion configuration and vice versa; and, a lower body portion: and, an inflatable bladder operatively associated with said inflation means and at least the upper body portion of said car body; wherein, the bladder is provided with: a valved inlet port for admitting air from said inflation means at an above atmospheric inflation pressure to restore the upper body portion of the car body to a normal body portion configuration; and, an overpressure responsive valved outlet port responsive to an increase in the pressure of the above atmospheric pressure air within the bladder for allowing the air within the bladder to escape to produce the crushed body portion configuration, in response to an external force being transmitted to the upper body portion by said crushing vehicle to produce the opening of said overpressure responsive valved outlet port.

2. The apparatus as in claim 1; wherein, the bladder comprises both the upper and the lower body portions of the car body.

3. The apparatus as in claim 1; wherein, the bladder comprises the upper body portion.

4. The apparatus as in claim 1; wherein, the upper body portion comprises: the roof; the hood; and the trunk of the car body.

5. The apparatus as in claim 4; wherein, the lower body portion comprises the wheels and at least a part of the chassis of the car body.

6. The apparatus as in claim 4; wherein, the bladder comprises the roof of the car body.

7. The apparatus as in claim 1; wherein, the inlet and outlet ports are provided with one way valves.

8. The apparatus as in claim 7; wherein, the inlet and outlet ports are formed in the bladder.

9. The apparatus as in claim 7; wherein, the inlet and outlet ports are formed in the car body.

10. The apparatus as in claim 5; wherein, the lower body portion of the car body is provided with at least one aperture and the bladder is provided with a downwardly depending post element dimensioned to be received in said aperture.

11. The apparatus as in claim 10; wherein, the post element is solid.

12. The apparatus as in claim 10; wherein, the post element is hollow and allows fluid communication between the bladder and the lower body portion.

13. The apparatus as in claim 4; wherein, the hood and the trunk comprise panels that are pivotally connected to the upper body portion.

14. The apparatus as in claim 13; further including means for forcibly pivoting the panels relative to the car body.

15. The apparatus as in claim 14; wherein, said means comprises pneumatic means.

16. The apparatus as in claim 14; wherein, the means comprises mechanical means.

17. The apparatus as in claim 14; wherein, the means comprises electro-mechanical means.

18. The apparatus as in claim 1; wherein, means are associated with said outlet port for generating simulated smoke.

19. The apparatus as in claim 4; wherein, the bladder is operatively associated with the roof of the car body.

20. The apparatus as in claim 4; wherein, the bladder comprises at least a portion of the roof of the car body.

21. The apparatus as in claim 4; wherein, the roof of the car body is fabricated from an air impervious membrane.

22. The apparatus as in claim 1; wherein, at least a part of the upper body portion of the car is fabricated from a deformable material.

23. The apparatus as in claim 1; including, a plurality of car bodies arranged in side by side fashion wherein, the car bodies are pneumatically connected to one another in a serial fashion.

24. The apparatus as in claim 23; wherein, each of the car bodies are provided with a female connector element on one side of the car body and a male connector element on the other side of the car body.

25. The apparatus as in claim 24; wherein, the inlet port and the outlet port are associated with the male and female connector elements.

26. The apparatus as in claim 25; wherein, the inlet ports and the outlet ports are provided with one way valves.

27. The apparatus as in claim 26; wherein, the male connector element is dimensioned to open the one way valve in the female connector element.

28. The apparatus as in claim 23; wherein, the car bodies are interconnected in a serial fashion through said ramp arrangement.

29. A ramp arrangement in combination with an inflation means and a plurality of deformable toy car bodies; wherein, the ramp arrangement comprises:

an elevated front ramp; a reduced height rear ramp; and guide means which extend between the front and rear ramps; wherein, the said plurality of deformable toy car bodies are pneumatically connected to one another via said inflation means in a serial fashion; and, said plurality of deformable toy car bodies are disposed in a side to side arrangement relative to one another intermediate the front and rear ramps.

30. The ramp arrangement as in claim 29; wherein, the front and rear ramps are movably associated with one another such that different numbers of crushable toy cars may be captively engaged between the ramps.

31. The ramp arrangement as in claim 29; further including an intermediate portion which rigidly connects the front and rear ramps together.

32. The ramp arrangement as in claim 29; wherein, the guide means comprises raised sidewalls.

33. The ramp arrangement as in claim 32; wherein the raised sidewalls are transparent.

34. A ramp arrangement in combination with an inflation means and a plurality of deformable toy car bodies; wherein, the ramp arrangement comprises:

an elevated front ramp; a reduced height rear ramp; and guide means which extend between the front and rear ramps; wherein, the plurality of deformable toy car bodies are pneumatically interconnected via said inflation means in a parallel fashion; wherein, the inflation means extends through at least a portion of one of said ramps; and, wherein the plurality of deformable toy car bodies are disposed in a side to side arrangement relative to one another intermediate the front and rear ramps.

35. The ramp arrangement as in claim 34; wherein, said pneumatic interconnection occurs through said ramp arrangement.

36. The combination as in claim 34; wherein said bladders are pneumatically connected in a series fashion.

37. The combination as in claim 34; wherein said bladders are pneumatically connected in a parallel fashion.

38. The combination as in claim 34; wherein said pneumatic means are at least partially contained within said ramp arrangement.

39. An inflatable recrushable toy car apparatus in combination with a crushing vehicle and a ramp arrangement comprising a plurality of recrushable toy car bodies wherein each of the car bodies has an upper body portion, and a lower body portion, an inflatable bladder operatively associated with at least a part of the upper body portion of each of said car bodies; and, at least one valved inlet and at least one valved outlet which are operatively associated with all of the inflatable bladders in said plurality of car bodies.

a ramp arrangement including an elevated front ramp, a reduced height rear ramp and an intermediate connecting member for receiving said plurality of car bodies in a side to side relationship a crushing vehicle for applying a downwardly directed deforming force to at least the upper portion of said car bodies through the escape of air from said at least one valved outlet operatively associated with the bladders in said plurality of car bodies; and, pneumatic means associated with said at least one valved inlet to restore the upper portion of the car bodies from their deformed condition to their original condition by the inflation of said bladders in the plurality of car bodies.

40. The apparatus as in claim 39; including, a plurality of car bodies arranged in side by side fashion; wherein, the car bodies are pneumatically interconnected in a parallel fashion.

41. The apparatus as in claim 40, wherein, each of the car bodies are provided with a stanchion; each of the stanchions are connected to one another and operatively connected to a branch conduit; and each of the branch conduits are connected to a main conduit for introducing positive pressure air through the stanchions into the interior of the car bodies.

42. The apparatus as in claim 41; wherein, each of the stanchions are provided with oppositely directed one way valves that serve as inlet and outlet posts for the car bodies.

43. The apparatus as in claim 42; wherein, said main conduit has an outlet port equipped with a removable closure.

44. The apparatus as in claim 43; wherein, the main conduit is further provided with a pressure relief valve.

45. The apparatus as in claim 44; wherein, the car bodies are interconnected in a parallel fashion through said ramp arrangement.

* * * * *